US007358909B2

(12) United States Patent
Sherwood

(10) Patent No.: US 7,358,909 B2
(45) Date of Patent: Apr. 15, 2008

(54) MOTORIZED, RETRACTABLE ANTENNA SYSTEM FOR RECREATIONAL AND SIMILAR VEHICLES

(75) Inventor: William J. Sherwood, West Burlington, IA (US)

(73) Assignee: Winegard Company, Burlington, IA (US)

( * ) Notice: Subject to any disclaimer, the term of this patent is extended or adjusted under 35 U.S.C. 154(b) by 374 days.

(21) Appl. No.: 11/236,276

(22) Filed: Sep. 27, 2005

(65) Prior Publication Data

US 2007/0069963 A1 Mar. 29, 2007

(51) Int. Cl.
*H01Q 1/32* (2006.01)

(52) U.S. Cl. ..... 343/713; 343/757; 343/766; 343/882

(58) Field of Classification Search ..... 343/713, 343/757, 766, 882, 839, 878, 765, 880
See application file for complete search history.

(56) References Cited

U.S. PATENT DOCUMENTS

| | | | | |
|---|---|---|---|---|
| 2,367,164 | A | 1/1945 | Yerger | |
| 3,739,387 | A | 6/1973 | Budrow et al. | |
| 4,253,099 | A * | 2/1981 | Yamazaki et al. | 343/713 |
| 4,254,419 | A | 3/1981 | Noddin | |
| 4,663,633 | A | 5/1987 | Wilson | |
| 4,725,843 | A | 2/1988 | Suzuki et al. | |
| 4,794,399 | A | 12/1988 | Sensibaugh | |
| 4,811,026 | A | 3/1989 | Bissett | |
| 4,887,091 | A | 12/1989 | Yamada | |
| 5,061,936 | A | 10/1991 | Suzuki | |
| 5,077,560 | A * | 12/1991 | Horton et al. | 342/359 |
| 5,262,793 | A | 11/1993 | Sperry | |
| 5,364,049 | A | 11/1994 | Long | |
| 5,417,178 | A * | 5/1995 | Harrelson, II | 114/343 |
| 5,929,817 | A | 7/1999 | Clark | |
| 5,959,593 | A | 9/1999 | Hoshi | |
| 5,999,139 | A * | 12/1999 | Benjamin et al. | 343/765 |
| 6,476,778 | B1 | 11/2002 | Hussaini et al. | |
| D500,496 | S | 1/2005 | Sherwood | |
| 7,173,571 | B2 * | 2/2007 | Webb et al. | 343/766 |

OTHER PUBLICATIONS

Winegard Sensar Antenna, Installation/Operation Manual (All Models), Jan. 2004, pp. 1-8, Winegard Company, Burlington, Iowa, U.S.A.

Concord Electric, Series 90 RV TV Antenna, Installation and Operating Instructions—Service and Parts Information, Sep. 13, 2001, pp. 1-8, Braund Manufacturing Company, Battle Creek, Michigan, U.S.A.

* cited by examiner

*Primary Examiner*—Tho Phan
(74) *Attorney, Agent, or Firm*—W. Scott Carson

(57) ABSTRACT

A motorized, retractable antenna system for a recreational or similar vehicle. The antenna system includes an antenna head pivotally mounted to a support arrangement for rotation about a substantially horizontal axis between retracted and raised position. The support arrangement and attached antenna head in turn are then mounted to a stationary base assembly for rotation about a substantially vertical axis. A locking mechanism is provided to secure the retracted antenna head and support arrangement in predetermined positions relative to the base assembly and vehicle and to aid in the control of the raising, adjusting, and lowering of the antenna head.

21 Claims, 14 Drawing Sheets

MOTORIZED, RETRACTABLE ANTENNA SYSTEM FOR RECREATIONAL AND SIMILAR VEHICLES

BACKGROUND OF THE INVENTION

1. Field of the Invention

This invention relates to the field of antennas for recreational and similar vehicles and more particularly to the field of such antennas that are retractable and motorized.

2. Discussion of the Background

Recreational and similar vehicles commonly have televisions and other receivers available for the use and enjoyment of the occupants. With such vehicles, it is important to be able to raise and adjust the antenna for best reception and to lower the antenna for travel. In the lowered position, the antenna is preferably as flush as possible with the vehicle roof and properly oriented to offer as small a profile as possible to the direction of travel of the vehicle. In this manner and in the lowered or travel position, the antenna is least likely to be damaged by hitting overhead objects such as low hanging tree limbs and by wind and wind blown trash and other items.

Most current antenna systems are hand operated wherein a crank is manually operated to raise, adjust, and lower the antenna head. These can present problems as the operating crank is typically inside the vehicle. Consequently, the operator often must rely on his sense of feel on the crank as to whether the antenna head has been properly and fully raised, lowered, or rotated to either of the rotational limits.

With this and other problems in mind, the present invention was developed. With it, the operations of the antenna system including the raising, rotating, and lowering of the antenna head have been motorized and automated to a large degree for ease and simplicity as well as safety. In particular, the raising step has been automated to ensure the antenna head is properly extended into its fully upright position before any rotational adjustments can be made to tune in on the signal. Additionally, the lowering step has been automated to ensure the antenna head is fully and safely retracted or lowered in the proper front-to-back orientation with the direction of travel of the vehicle.

SUMMARY OF THE INVENTION

This invention involves a motorized, retractable antenna system for a recreational or similar vehicle in which the operations to raise, adjust, and lower the antenna head are controlled in a safe and efficient manner. The antenna system includes an antenna head pivotally mounted to a support arrangement for rotation about a substantially horizontal axis between retracted and raised position. The support arrangement and attached antenna head in turn are then mounted to a stationary base assembly for rotation about a substantially vertical axis.

A locking mechanism is provided to secure the retracted antenna head and support arrangement in predetermined positions relative to the base assembly and vehicle. The locking mechanism also prevents the antenna head and support arrangement from being rotated about the vertical axis unless and until the antenna head is properly extended in its up position. The locking mechanism additionally prevents the antenna head from being lowered unless and until the antenna head is in its predetermined orientation (e.g., front-to-back) to the vehicle. The steps to properly raise and lower the antenna head are substantially automated for safe and efficient operation and include signal lights on the control panel to alert the operator that the various parts of the antenna system are in their proper positions and operating correctly.

BRIEF DESCRIPTION OF THE DRAWINGS

FIG. 10(*a*) is a cross sectional view of the cap of the support arrangement and the parts of the pivotal mechanism for the antenna head and the locking mechanism mounted to it.

DETAILED DESCRIPTION OF THE INVENTION

Figure 1:
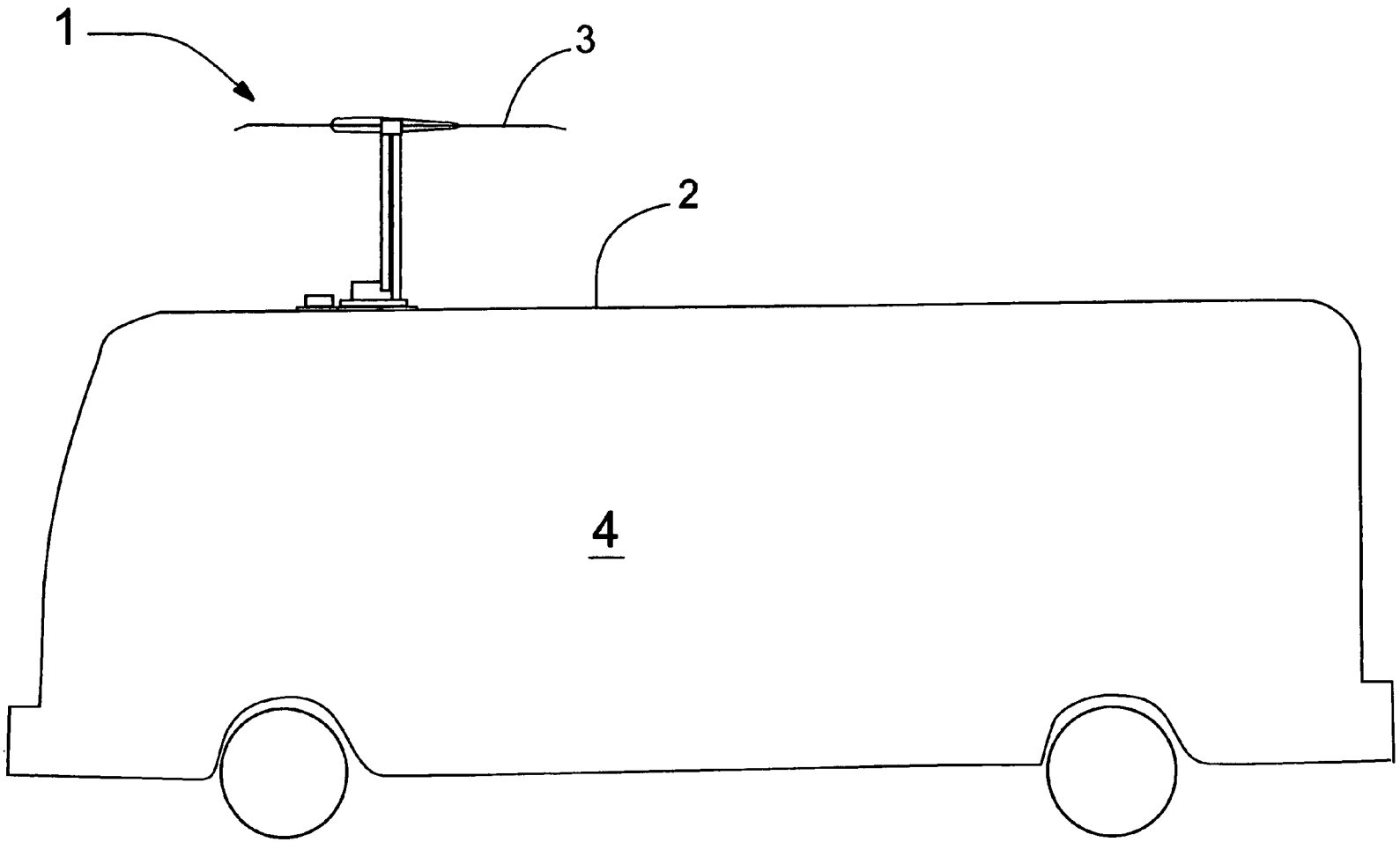
FIG. 1 is a schematic view of the antenna system of the present invention mounted on a recreational or other vehicle with the antenna head in its raised or extended position.
Figure 2:
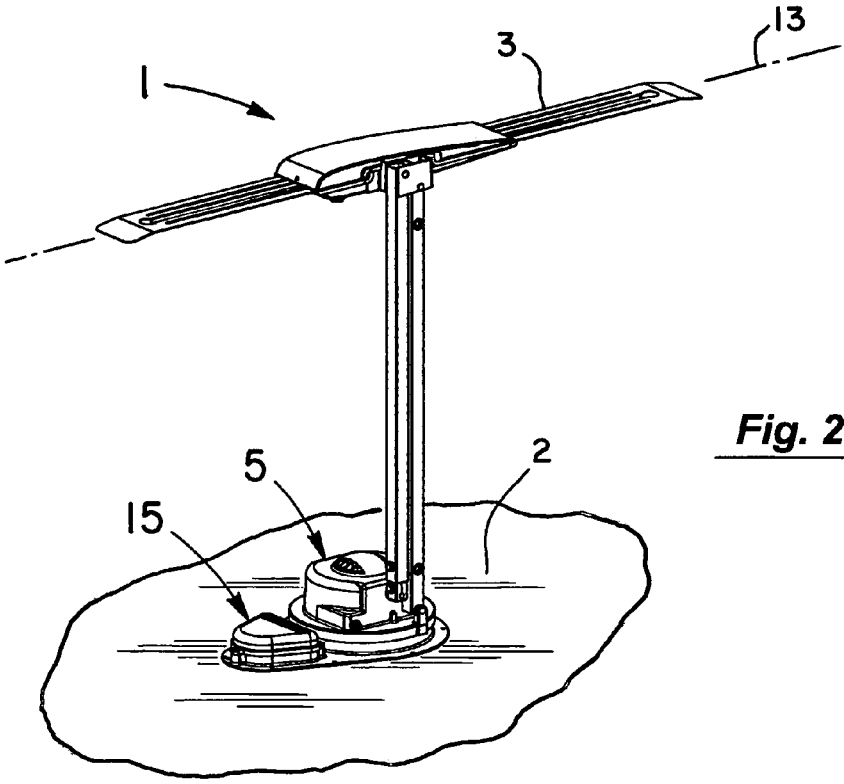
FIG. 2 is a perspective view of the antenna system of FIG. 1.
Figure 3:
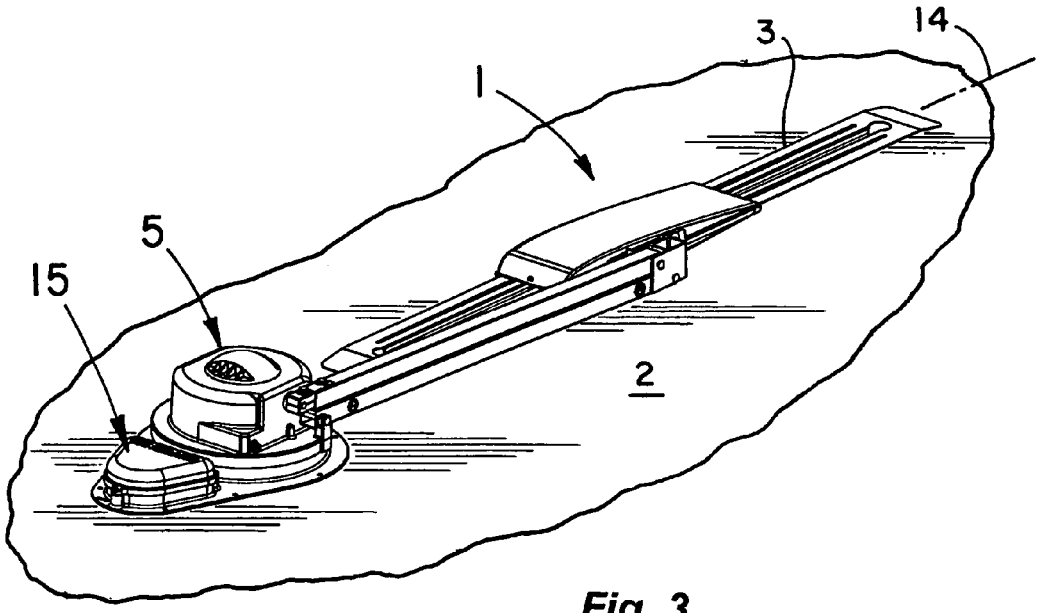
FIG. 3 is a view similar to FIG. 2 but with the antenna head in its lowered or retracted position substantially flush with the vehicle roof.

FIGS. 1 and 2 illustrate the motorized, retractable antenna system 1 of the present invention with the antenna head 3 in an extended or raised position atop the roof 2 of a recreational or similar vehicle 4. In FIG. 3, the antenna head 3 is shown in a retracted or lowered position substantially flush against the vehicle roof 2.

Figure 4:
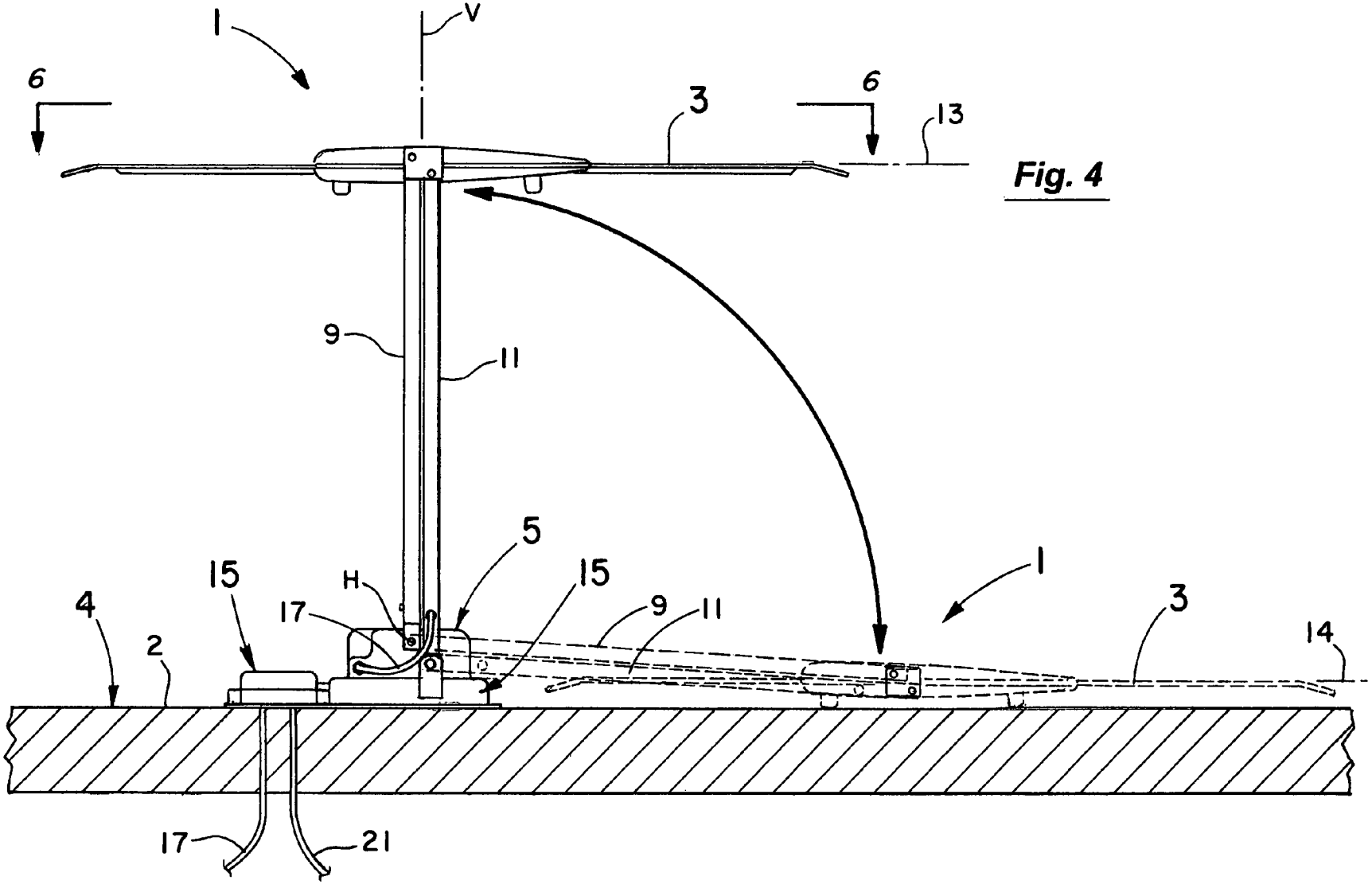
FIG. 4 is a side view of the antenna system with the antenna head shown in solid lines in its raised position and in dotted lines in its retracted position.

The antenna system 1 as best seen in FIG. 4 includes the antenna head 3. As illustrated, the antenna head 3 is pivotally mounted to the support arrangement 5 for movement relative thereto about the substantially horizontal axis H of the main, support arm 9. The pivotally mounted second or guiding arm 11 is provided in the illustrated embodiment of FIG. 4 to create a generally parallelogram structure. In this manner, the antenna head 3 remains substantially horizontal along axes 13 and 14 in the extended or raised position shown in solid lines in FIG. 4 as well as in the retracted or lowered position shown in dotted lines. The support arrangement 5 for pivotally mounting the antenna head 3 as explained in more detail below is in turn mounted to the base assembly 15 affixed to the roof 2 of the vehicle 4. The coaxial or other cable 17 of FIGS. 4 and 5 preferably passes from the television 18 or other receiver (FIG. 5) through the vehicle roof 2 into the base assembly 15 and up the pivot arm 11 (FIG. 4) to the antenna head 3. The connecting cable 21 of the control panel 23 (FIG. 5) for the antenna system 1 preferably also passes up through the vehicle roof 2 to the base assembly 15.

Figure 5:
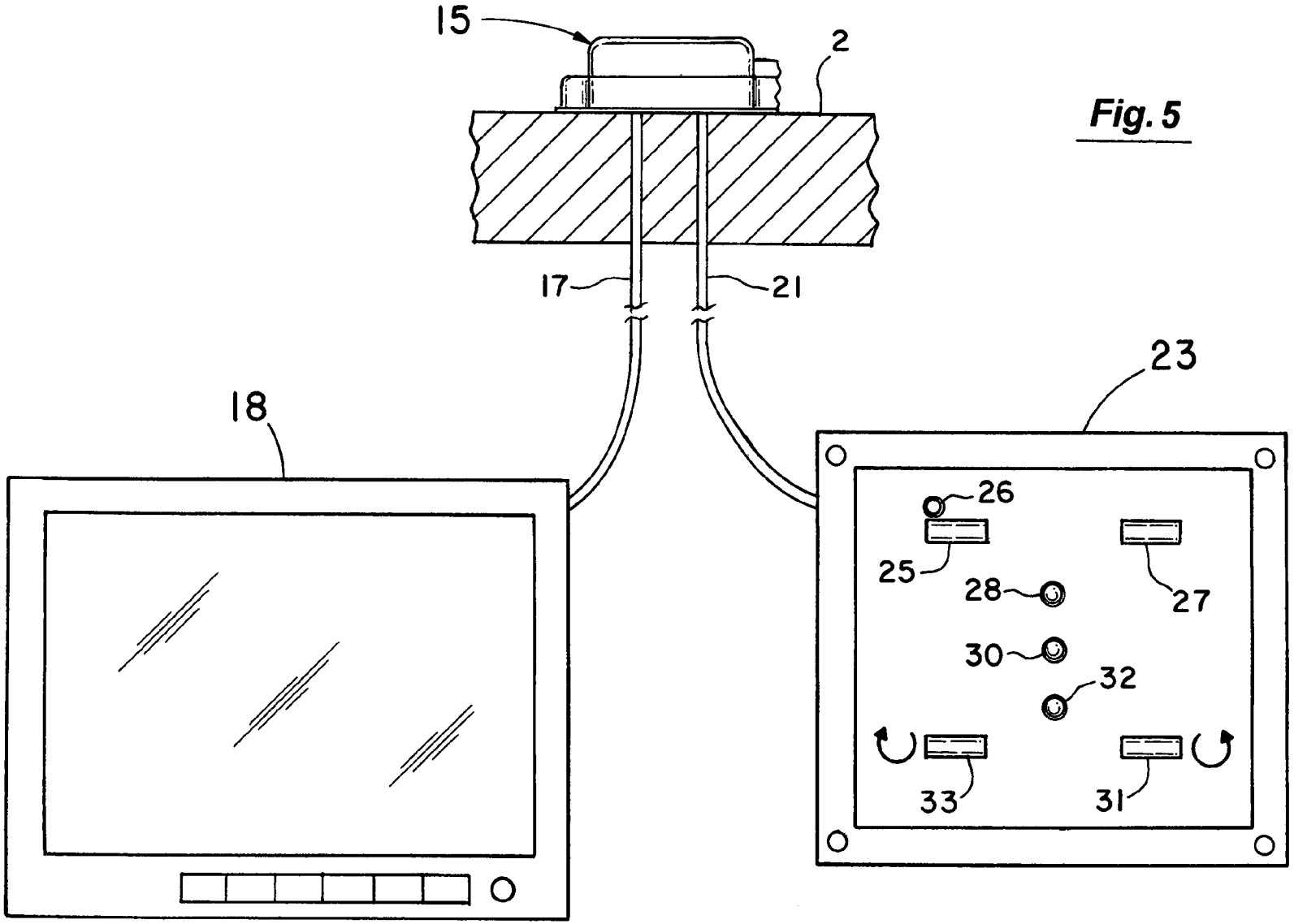
FIG. 5 is a schematic view of the television or other receiver and the control panel for the antenna system.
Figure 6:
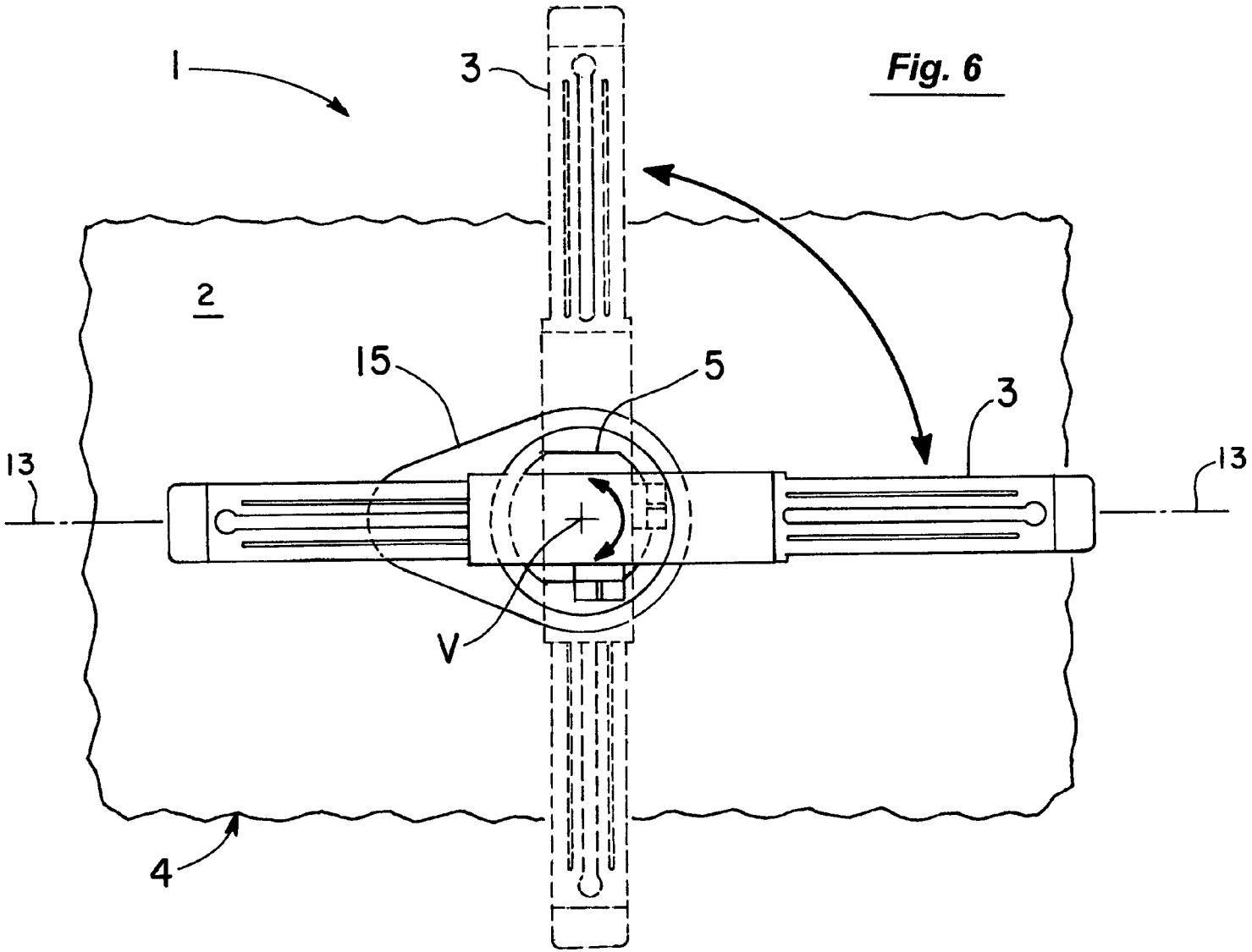
FIG. 6 is a plan view taken along line 6-6 of FIG. 4 illustrating the antenna head being rotated about the vertical axis of FIG. 4.

In operation, the antenna head 3 can be selectively raised and lowered (FIG. 4) as well as rotated about the vertical axis V to adjust the reception (see also FIG. 6). In doing so and with the antenna head 3 initially in the retracted or lowered position shown in dotted lines in FIG. 4, power button 25 of the control panel 23 of FIG. 5 is first pushed on. The power indicator light 26 is then lit to alert the operator. The up button 27 of FIG. 5 can thereafter be depressed to extend or raise the antenna head 3 to the up position shown in full lines in FIG. 4. In this position, the up light 28 of FIG. 5 will become lit for reference by the user. The counterclockwise rotation button 31 is next pushed and held to rotate the raised antenna head 3 of FIG. 4 about the vertical axis V (see also FIG. 6) to tune into the signal. Fine adjustments can thereafter be made by alternately pushing and holding the clockwise button 33 and counterclockwise button 31 until the best reception is received. During such rotational motion, the light 30 of FIG. 5 is lit indicating the antenna head 3 is moving.

To retract or lower the antenna head 3, the button 27 is again depressed which will start a series of steps (discussed in more detail below) that will automatically rotate and properly lower the antenna head 3. In doing so, the antenna head 3 is first automatically rotated about the vertical axis V to a predetermined orientation relative to the axis V. In this predetermined orientation, the axis 13 of the elongated antenna head 3 of FIGS. 4 and 6 is aligned front-to-back with the vehicle 4. Thereafter, the antenna head 3 will be retracted or lowered to the dotted position of FIG. 4 and locked in place from moving or rotating about the vertical axis (V). The down light 32 of FIG. 5 will then be lit signifying to the operator that the antenna head 3 is properly lowered and safely locked in place for travel. In the retracted or lowered position as indicated above, the antenna head 3 is least likely to be damaged by low hanging tree limbs or bushes as the vehicle 4 is driven as well as by wind and wind blown trash or other items. That is, the profiles of the antenna head 3 and support arms 9 and 11 in this lowered position are at a minimum and preferably located behind the protecting support arrangement 5 and base assembly 15.

Figure 7:
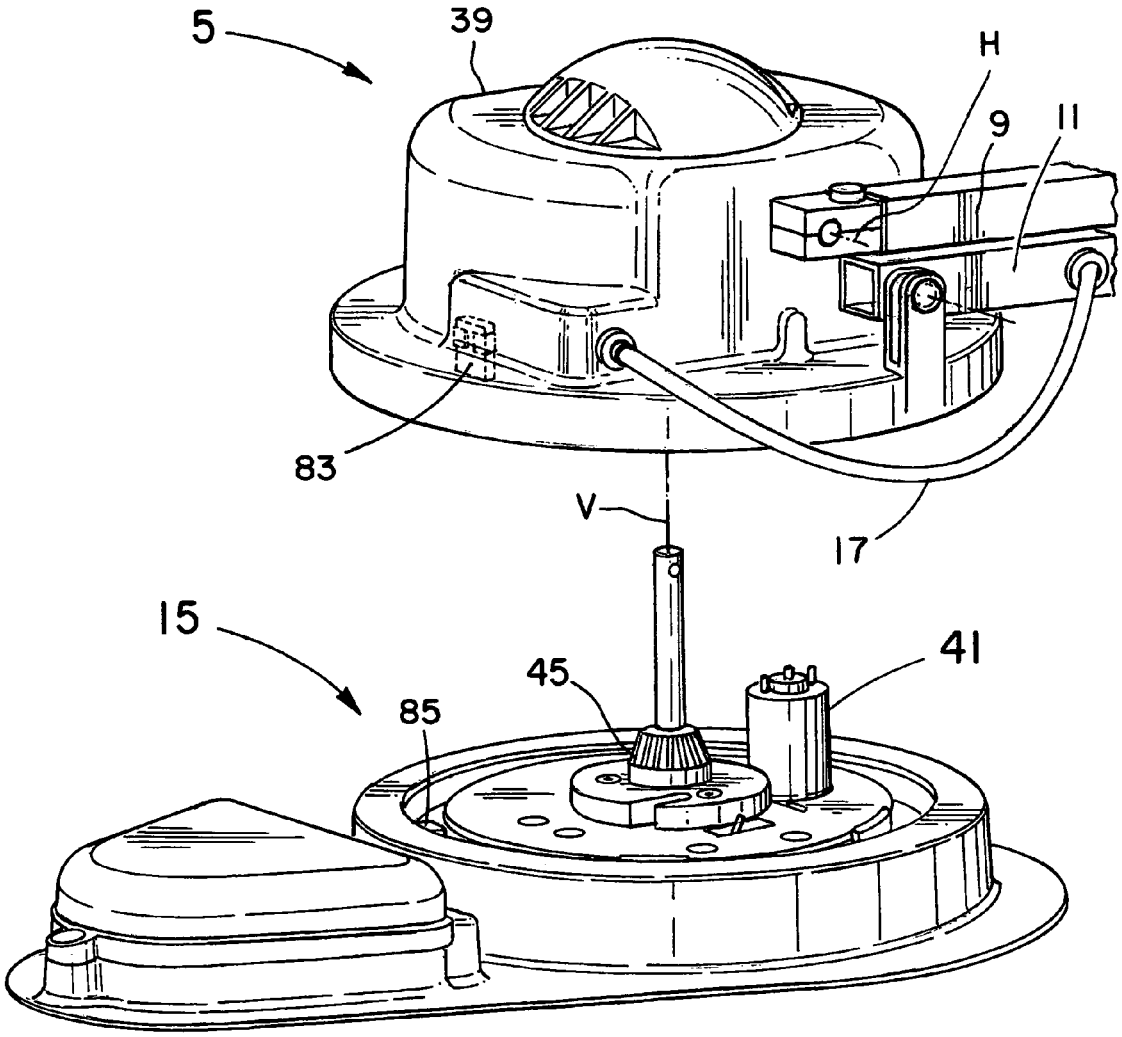
FIG. 7 is a partially exploded view of the antenna system of the present invention.
Figures 8, 9:
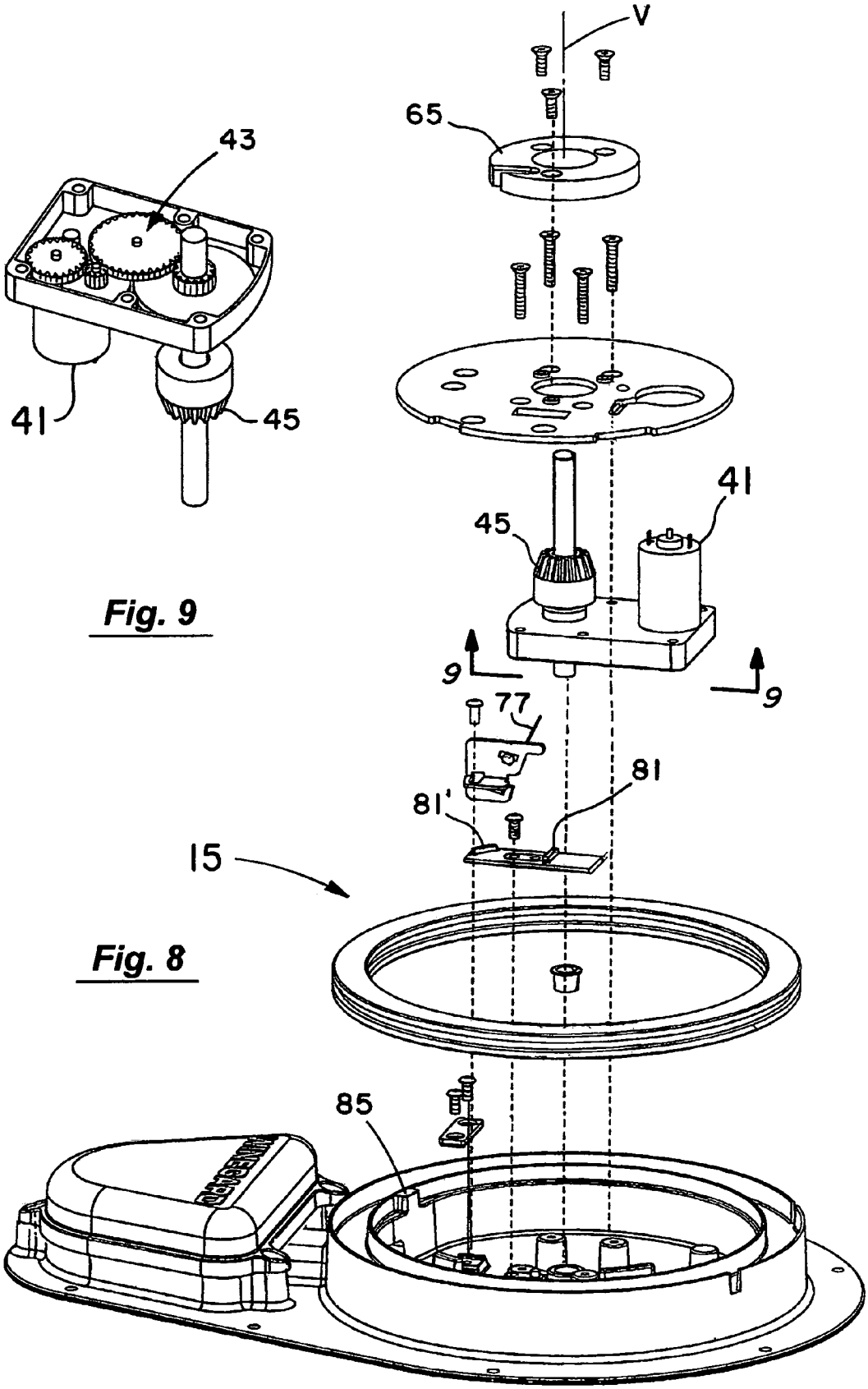
FIG. 8 is an exploded view of the base assembly of the antenna system.
FIG. 9 is an inverted view taken along line 9-9 of FIG. 8.
Figure 10:
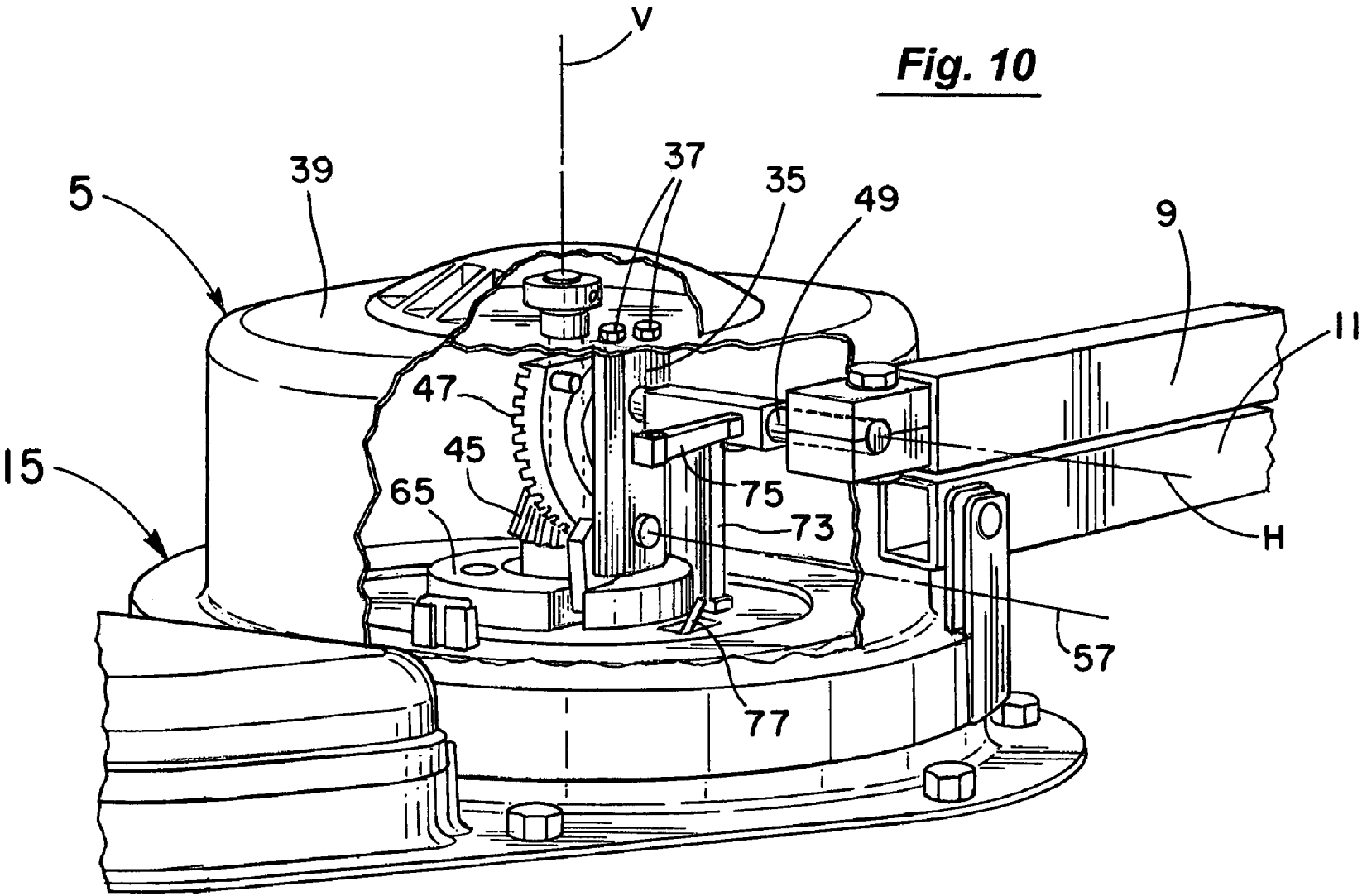
FIG. 10 is a broken away view of the support arrangement for the antenna head and the underlying, stationary base assembly when the antenna head is in its lowered or retracted position.
Figure 10A:
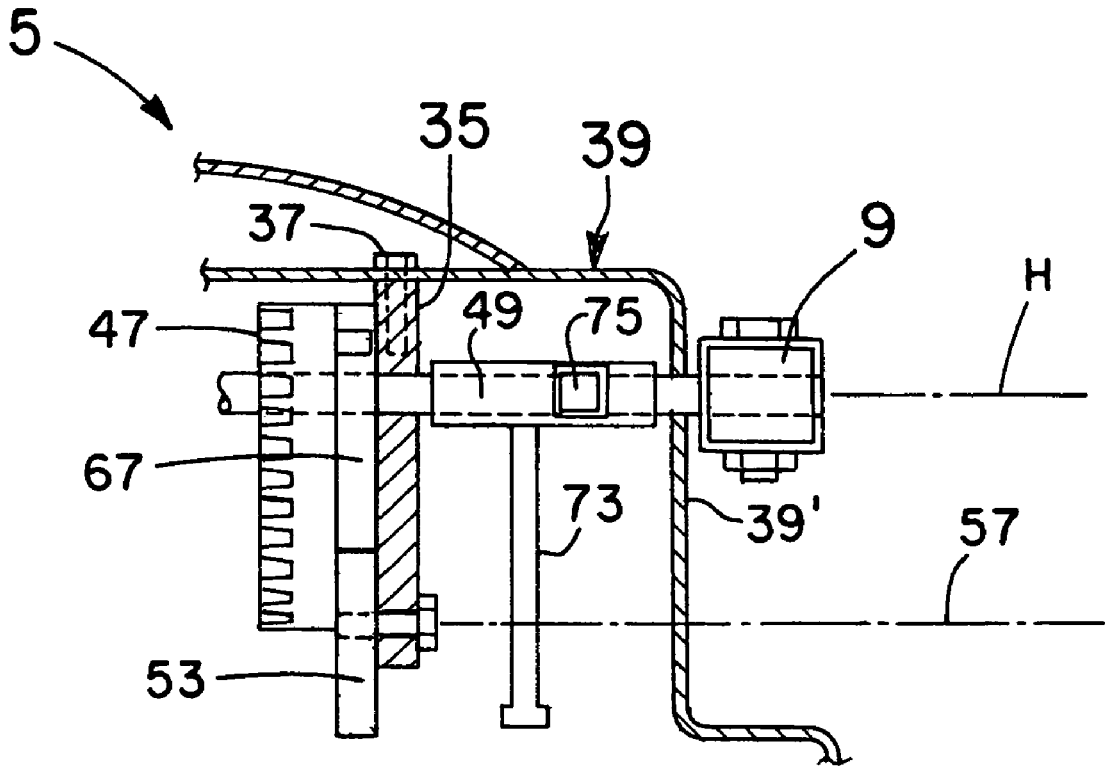
Figure 11:
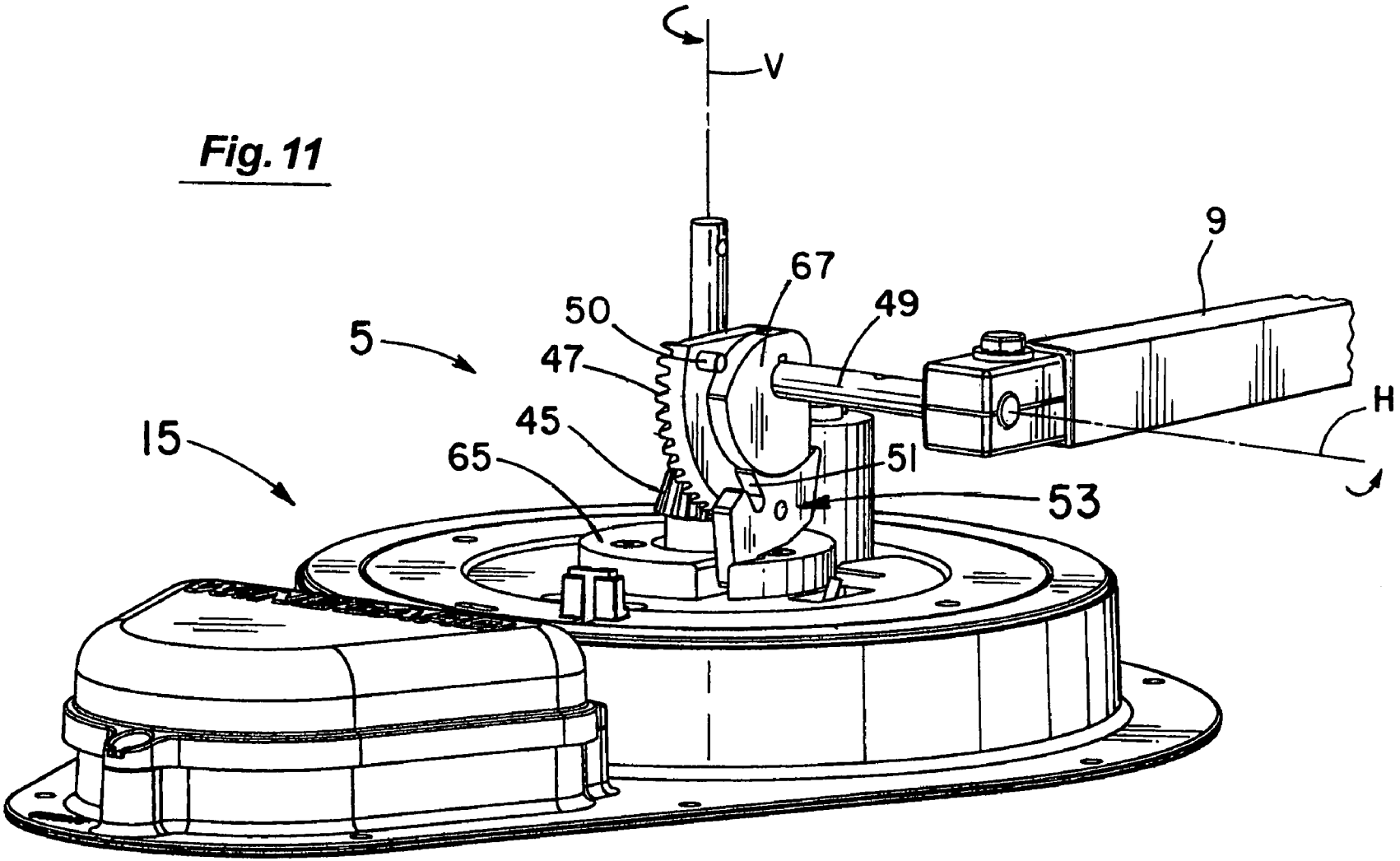
FIG. 11 is a view similar to FIG. 10 with parts removed for clarity.
Figure 12:
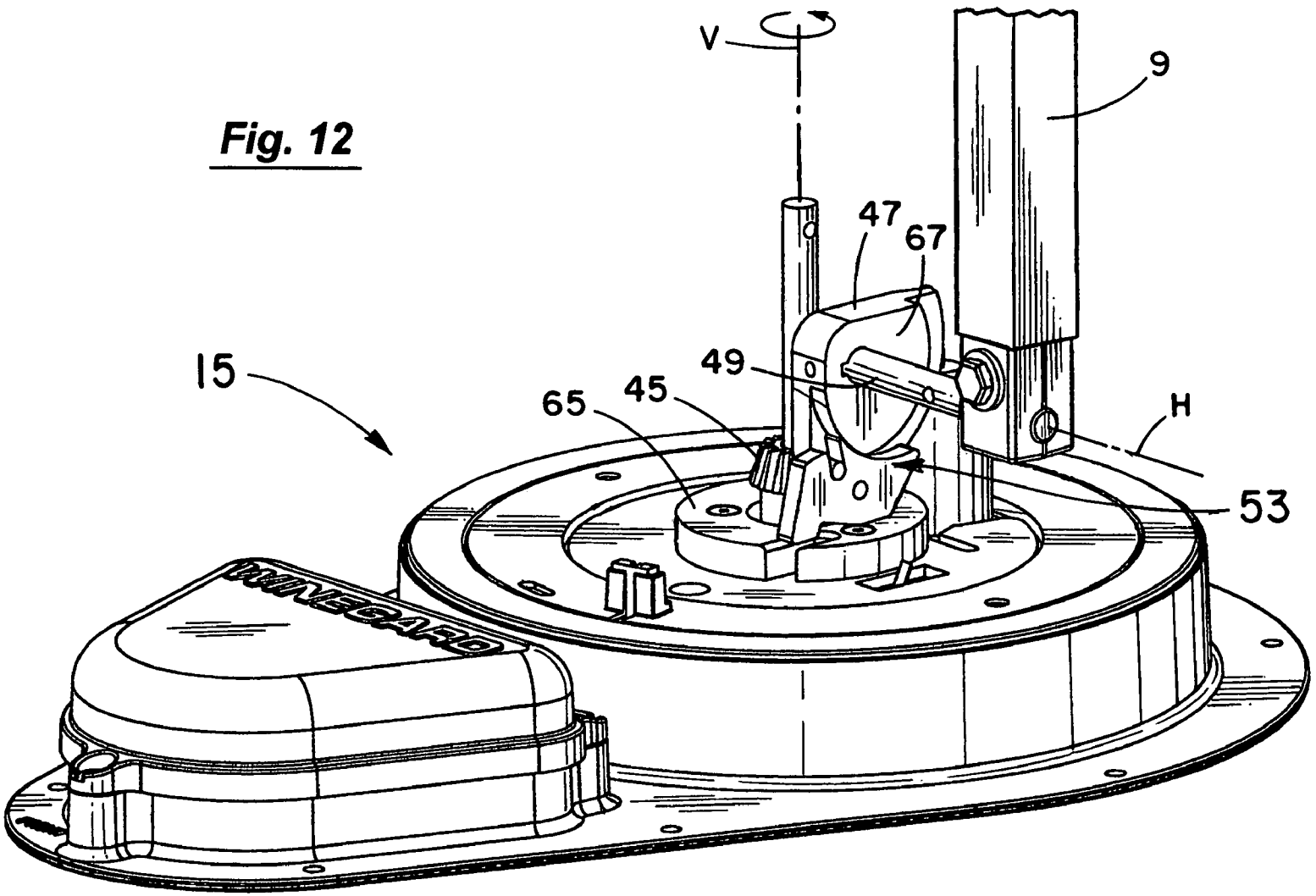
FIG. 12 is a view of the parts of FIG. 11 with the antenna head in its raised or extended position.
Figure 13:
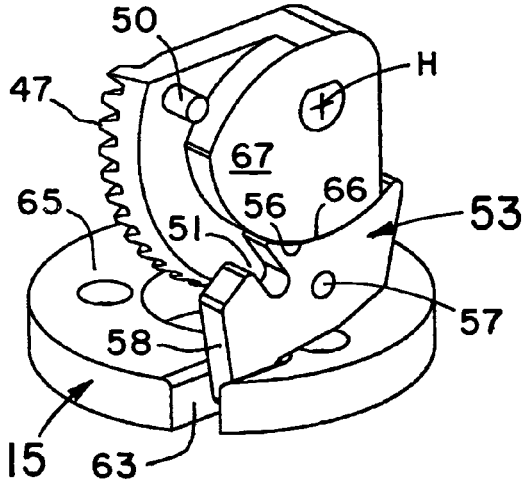
FIG. 13-17 sequentially show the operation of the locking mechanism of the present invention controlling the raising of the antenna head. The illustrated sequence in reverse controls the lowering of the antenna head.
Figure 14:
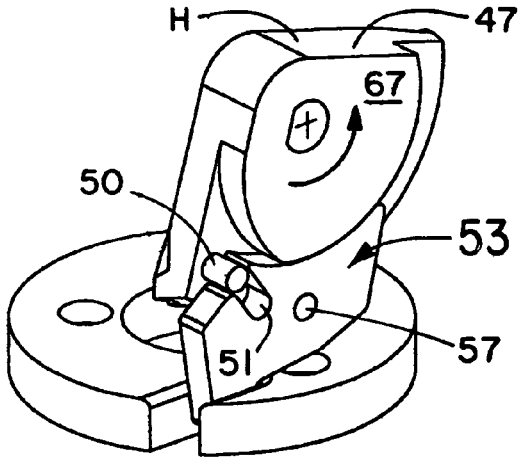

The raising, rotating, and lowering motion of the antenna head 3 is accomplished by the operation of the pivotal mounting structure of the antenna head 3 in cooperation with the support arrangement 5 of FIG. 7 (to which the arms 9 and 11 supporting the antenna head 3 are pivotally mounted) and the motorized base assembly 15. More specifically, the reversible motor 41 of the base assembly 15 (see FIGS. 7-9) operates through a series of gears 43 (FIG. 9) to selectively rotate the drive gear 45 of the base assembly 15 (FIGS. 7-8). This rotation is in either direction about the vertical axis V. The drive gear 45 in turn engages and selectively rotates the driven gear 47 (FIGS. 10, 11, and 12) of the pivotal mounting or mechanism for the antenna head 3 and its main arm 9. This will then selectively pivot the main antenna arm 9 (to which the antenna head 3 is attached) about the horizontal axis H relative to the support arrangement 5 between the retracted or lowered position (FIG. 11) and the extended or raised position (FIG. 12). Once in the raised or up position of FIG. 12, the antenna head 3 can be selectively rotated counterclockwise and clockwise about the vertical axis V as needed (FIG. 6) to hone in on the signal. It is noted at this point that some of the parts of the support arrangement 5 and base assembly 15 are not shown in FIGS. 11-12 for clarity. As for example, the structure of the support arrangement 5 supporting the antenna head 3 and its arm 9 as shown in FIGS. 10 and 10(*a*) includes the pillar block 35 of the support arrangement 5. This pillar block 35 as illustrated in FIGS. 10 and 10(*a*) is downwardly suspended by the screws 37 from the cap 39 of the support arrangement 5. The shaft 49 of the pivotal mounting or mechanism for the antenna head 3 in this regard is journalled in the pillar box 35 and side 39' (FIG. 10(*a*)) of the cap 39 of the support arrangement 5. This and other structure as indicated above are not shown in FIGS. 11 and 12 for clarity.

Referring again to FIGS. 10 and 11 and the sequential views of FIGS. 13-17 and 18-22, the interacting parts of the pivotal mounting or mechanism (including the driven gear 47 and shaft 49) for the antenna head 3 and the base assembly 15 are shown in operation. In these views, the antenna head 3 is being raised from the down position shown in dotted lines in FIG. 4. In the down position (see also FIGS. 11, 13, and 18), the antenna head 3 attached to the main arm 9 of FIG. 11 is in the retracted or lowered position and positively locked in place from moving or rotating about the vertical axis (V). In this parked position, the elongated antenna head 3 is substantially flush with the vehicle roof 2 and is aligned with the lower horizontal axis 14 of FIG. 4. The antenna head 3 then extends along axis 14 of FIGS. 3 and 4 front-to-back relative to the vehicle 4. This is the travel position for the antenna head 3 offering the lowest profile behind the protecting support arrangement 5 and base assembly 15 (which are spaced in front of the retracted antenna head 3 along the axis 14 as perhaps best seen in FIGS. 3 and 4).

Figure 15:
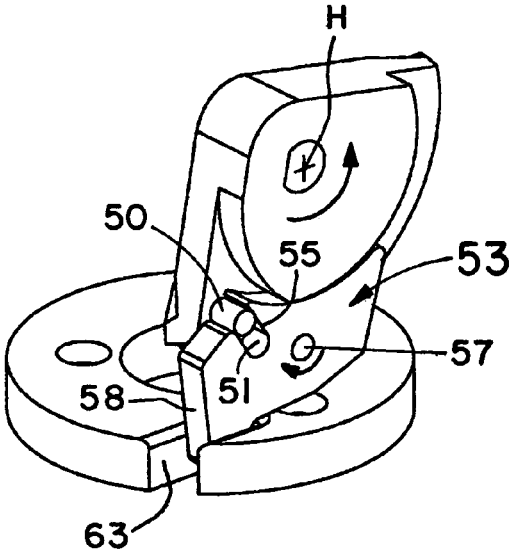
Figure 16:
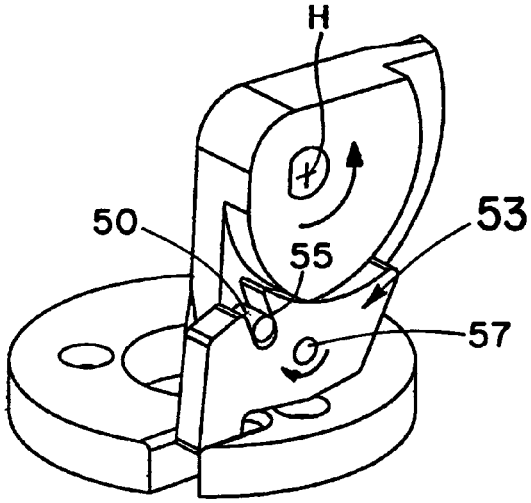
Figure 17:
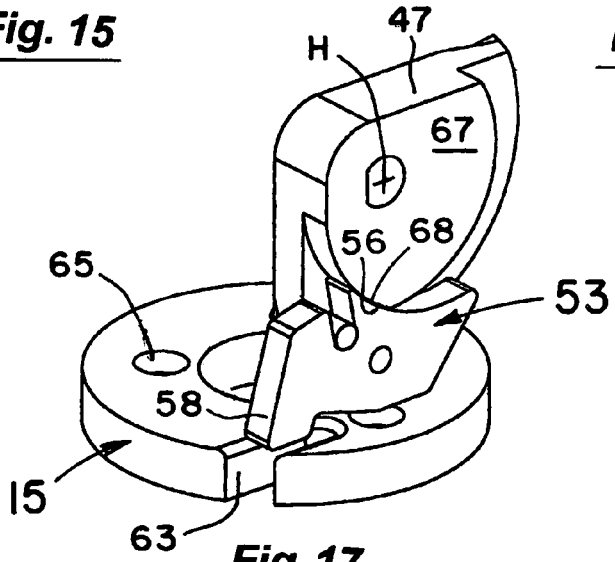
Figure 18:
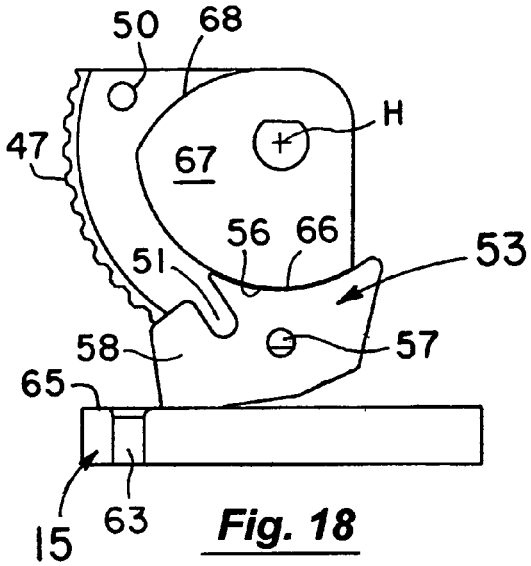
FIGS. 18-22 correspond to the perspective views of FIGS. 13-17.
Figure 19:
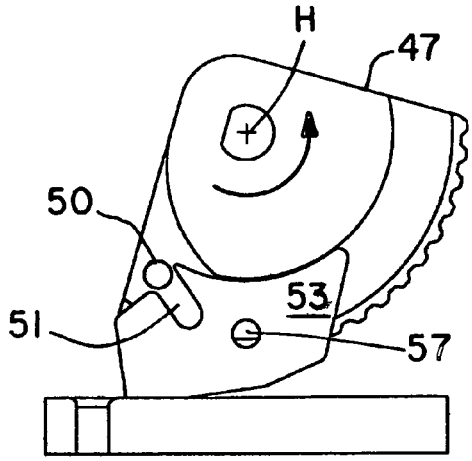
Figure 20:
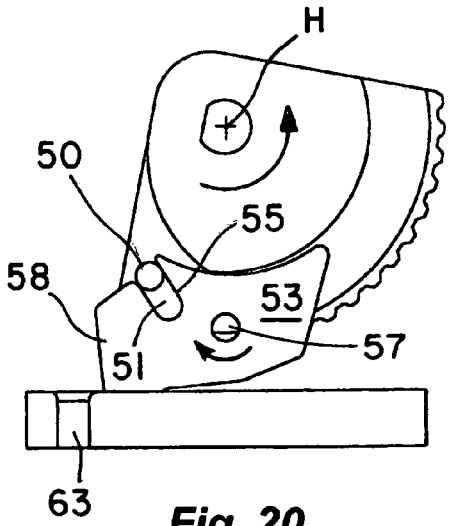
Figure 21:
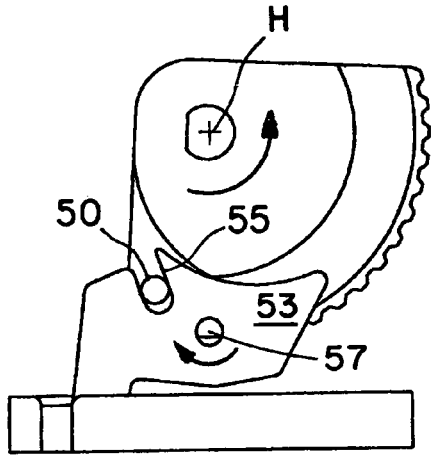
Figure 22:
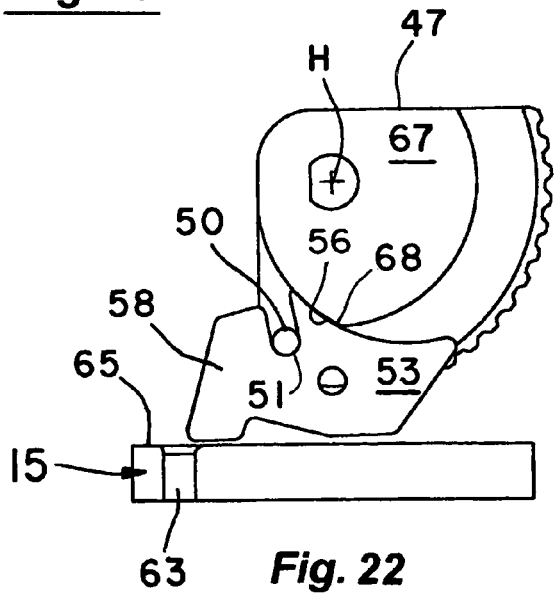

Once the vehicle 4 is stopped and it is desired to extend or raise the antenna head 3, the power button 25 of FIG. 5 is depressed followed by the up button 27. The motor 41 of the base assembly 15 will then be operated to rotate the main drive gear 45 of FIG. 11 counterclockwise about the vertical axis V. This in turn will rotate the driven gear 47 of the pivotal mounting or mechanism for the antenna head 3 of FIG. 11 (including the pin member 50 attached to the driven gear 47) counterclockwise about the horizontal axis H (see also FIGS. 14 and 19). In doing so, the pin member 50 will be received in the indent or recess 51 of the heel member 53 (FIGS. 15 and 20). The pin member 50 will then bind or rub against the inclined side 55 of the indent 51 to pivot the heel member 53 clockwise about the horizontal axis 57. The horizontal axes H and 57 in this regard are preferably spaced from and parallel to each other and the pin member 50 is preferably spaced from and extends along the axes H and 57. As indicated above, the pin member 50 enters and binds or rubs against the inclined side 55 of the indent or recess 51 (FIGS. 15-16 and 20-21). This in turn pivots the heel member 53 clockwise about the axis 57 and disengages or lifts the detent or heel 58 of the heel member 53 (see FIGS. 17 and 22) out of the notch portion 63 in the member 65 of the stationary base assembly 15.

Prior to this lifting of the detent member 58, the support arrangement 5 and attached antenna head 3 are positively prevented from being rotated or moved about the vertical axis V. That is, the support arrangement 5 and attached antenna head 3 cannot be driven about the vertical axis V with the antenna head 3 away from its predetermined, extended or raised position. This is due to the engaged locking mechanism including the mechanical detent 58 of FIGS. 13-16 and 18-21 received or engaged in the notch portion 63 of the stationary base assembly 15. Further aiding in this regard is the sliding contact and force between the cam surface 66 of the cam member 67 affixed to the driven gear 47 (FIGS. 13 and 18) and the abutting cam surface 56 of the heel member 53. The driven gear 47 of the pivotal mounting or mechanism for the antenna head 3 with the pin member 50 and cam member 67 attached thereto are thus rotated counterclockwise about the horizontal axis H in FIGS. 14-17 and 19-22. At the same time, the antenna head 3 is also being pivoted about the horizontal axis H to its extended or raised position shown in solid lined in FIGS. 4 and 12.

With the detent member 58 of the heel member 53 in its lifted or free position (FIGS. 17 and 22) out of the notch portion 63, the up light 28 of FIG. 5 is then lit. This informs the operator that the antenna head 3 is fully and properly raised and is ready to be rotated about the vertical axis V to tune into the signal for best reception. In doing so, the button 31 of FIG. 5 is pushed and held which will further move the drive gear 45 (FIG. 12) of the base assembly 15 counterclockwise about the vertical axis V. This in turn will rotate the support arrangement 5 and attached, raised antenna head 3 (via the driven gear 47 engaged by the drive gear 45) counterclockwise from the position of FIG. 12 about the vertical axis V. It is noted that the driven gear 47 of the pivotal mounting or mechanism for the antenna head 3 at this point is blocked from further rotation about the horizontal axis H. This is due to the pin member 50 bottoming out in the recess 51 of the heel member 53 (FIG. 22) and the abutting cam surfaces 56 and 68. Further and once the detent 58 is lifted and disengaged from the notch 63 (FIGS. 12, 17, and 22), the driven gear 47 of pivotal mounting or mechanism for the antenna head 3 with the pin member 50 and cam member 67 attached thereto are free to rotate with the raised antenna head 3 about the vertical axis V from the position of FIG. 12.

To return the raised antenna head 3 to the predetermined, retracted or lowered position for travel as shown in FIG. 3 and in dotted lines in FIG. 4, the operator need only depress the button 27 of FIG. 5 again. In response, the motor 41 will be driven to rotate the drive gear 45 clockwise about the vertical axis V. The sequence of FIGS. 13-17 and 18-22 will then be automatically reversed to lower or engage the detent member 58 in the notch 63 of the member 65 of the base assembly 15. The down light 32 of FIG. 5 will then light up to inform the operator that the antenna head 3 is now retracted in the proper alignment for travel. The locking mechanism of the detent member 58 and notch 63 in this regard will only permit or allow the antenna head 3 to be lowered in this properly aligned, travel position. If the support arrangement 5 and attached antenna head 3 for whatever reason cannot be initially rotated about the vertical axis V back to the proper front-to-back alignment with the vehicle 4, the locking mechanism of members 58 and 63 cannot be moved to the locked position of FIGS. 13 and 18. The down light 32 will then not be lit. The operator thus knows there is a problem that needs to be checked (e.g., a tree branch in the way stopping the support arrangement 5 and the attached antenna head 3 from being properly rotated to the aligned position). If the support arrangement 5 and attached antenna head 3 can be rotated back to be properly aligned front-to-back with the vehicle 4 but for whatever reason the antenna head 3 cannot be lowered and locked in place in the down position FIGS. 3, 4, 13, and 18, the same notice of trouble (i.e., the down light 32 is not lit) will be given.

The detent member 58 of the pivotal mounting for the antenna head 3 and the notch portion 63 of the member 65 of the base assembly 15 as indicated above function as part of a locking mechanism. The locking mechanism in this regard selectively secures the support arrangement 5 in its predetermined, aligned position about the vertical axis V with the antenna head 3 in its predetermined, aligned and retracted position of FIGS. 3 and 10. In the retracted and parked position of FIGS. 3 and 10, the engaged detent member 58 and notch member 63 will then secure the antenna head 3 and support arrangement 5 from being moved or rotated about the vertical axis V. Additionally, in the parked position with the motor 41 turned off or otherwise inactive, the drive train including the motor 41 and engaged gearing to the antenna head 3 will also resist any movement or rotation of the antenna head 3 about the horizontal axis H.

The detent member 58 and notch member 63 also serve to prevent the antenna head 3 from being lowered from its predetermined, extended position (FIGS. 2 and 4) unless the support arrangement 5 and attached antenna head 3 are in their predetermined, aligned positions about the vertical axis V. This is accomplished in part by the top surface of the member 65 that extends (e.g., 340 degrees) about the vertical axis V between the sides of the notch 63. Consequently, when the detent 58 of the heel member 53 of FIG. 12 is raised out of the notch 63 and rotated with the support arrangement 5 away from the position of FIG. 12, the top surface of member 65 will positively prevent the heel detent 58 and antenna head 3 from being lowered. That is, the support arrangement 5 must be in its predetermined, aligned position before the antenna head 3 can be retracted. This predetermined position of the support arrangement 5 as discussed above is preferably with the axis 13 of the elongated antenna head 3 (which is attached to the support arrangement 5) aligned front-to-back with the vehicle 4 and its direction of travel. It is noted at this point that the preferred alignment has been described as being front-to-back (or left-to-right in FIGS. 1 and 4) with the vehicle 4 but that these items could be orientated in another predetermined position if desired. The antenna head 3 in this regard has also been shown and described as being elongated and primarily for receiving television signals but could have other shapes and be used to receive other signals. The antenna system 1 has additionally been shown and described in use with a recreational or other vehicle 4 but it could be used in other applications including stationary ones.

Figure 23:
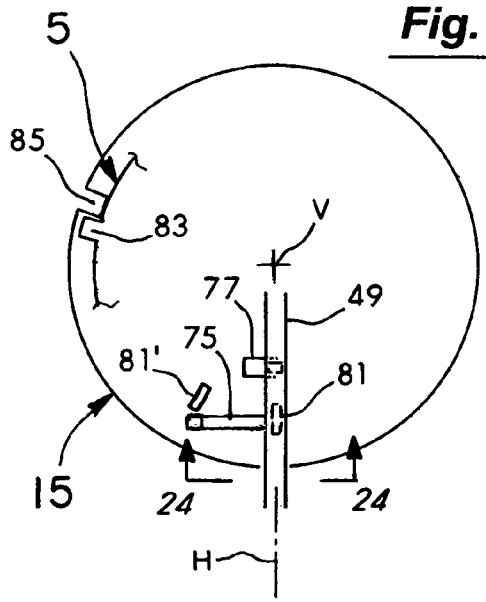
FIGS. 23-28 schematically illustrate in plan view the overall operation of the antenna system of the present invention to raise, adjust, and lower the antenna head.
Figure 24:
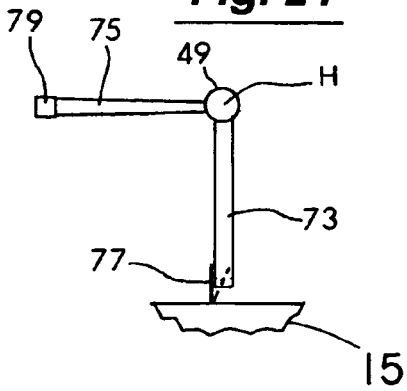
Figure 25:
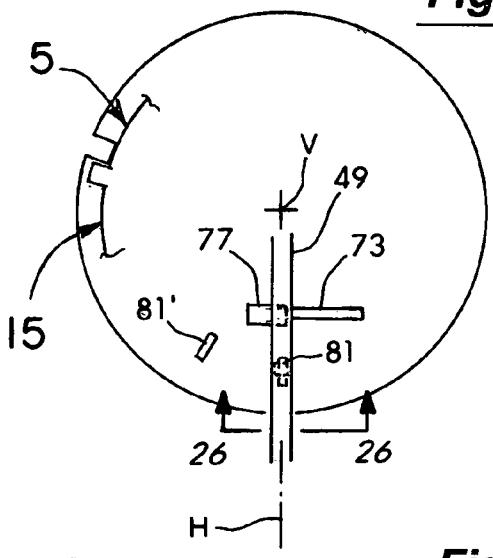
Figure 26:
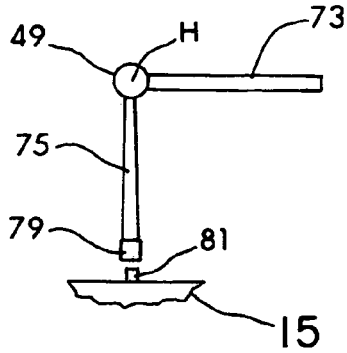

In any event and to aid in the desired and safe operation of the antenna system 1 of the present invention, various electronic and magnetic sensors and physical stops can be provided. As for example, the pivot bar or shaft 49 for the pivot arm 9 of the antenna head 3 (see FIG. 10) can be provided with a simple pair of arms 73 and 75 offset from each other about the horizontal axis H by about 90 degrees. As the antenna head 3 is lowered to its retracted position of FIGS. 3 and 4, the arm 73 will rotate clockwise about the axis H and physically contact and activate the trip or other switch 77 (see also the schematic plan views of FIGS. 23 and 24). This will signal the control panel 23 of FIG. 5 that the antenna head 3 is properly and fully lowered and the down light 32 will then be lit. Similarly, in the raised or extended position of FIGS. 2 and 4, the arm 75 (e.g., with the magnet 79 adjacent its end as illustrated in FIGS. 25 and 26) will be rotated counterclockwise with the shaft 49 to activate the first reed or other switch 81 to signal the control panel 23 that the antenna head 3 is properly and fully raised. The up light 28 on the control panel 23 of FIG. 5 will then be lit.

A second reed or other switch 81' as in FIG. 25 can be provided counterclockwise (e.g., 340 degrees) about the vertical axis V from the first reed switch 81. The first and second reed switches 81 and 81' in this regard act to control the extremes of the rotation of the support arrangement 5 and attached antenna head 3 about the vertical axis V. That is and with the counterclockwise rotation button 31 of FIG. 5 depressed and held, the support arrangement 5 and attached antenna head 3 will rotate counterclockwise about the axis V from the position of FIG. 25. This rotation will continue as long as the button 31 is depressed until the magnet 79 on the depending arm 75 (see FIGS. 27 and 28) activates the second reed switch 81' to stop the rotation. Similarly, when the clockwise button 33 is depressed and held during efforts to tune in on the signal, the magnet 79 on the depending arm 75 will stop the support arrangement 5 and attached antenna head 3 from rotating clockwise beyond the reed switch 81 (see FIGS. 25 and 26). In operation, maintaining the support arrangement 5 within these rotational limits serves to help prevent damage to any cables, wiring, or other connections between the rotating support arrangement 5 and the underlying stationary base assemble 15. Should the reed or other switches 81,81' fail, the mechanical stops 83 and 85 on the support arrangement 5 and base assembly 15 in FIGS. 7, 23 and 27 will abut and prevent any undesirable rotation that might damage the connections.

Figure 27:
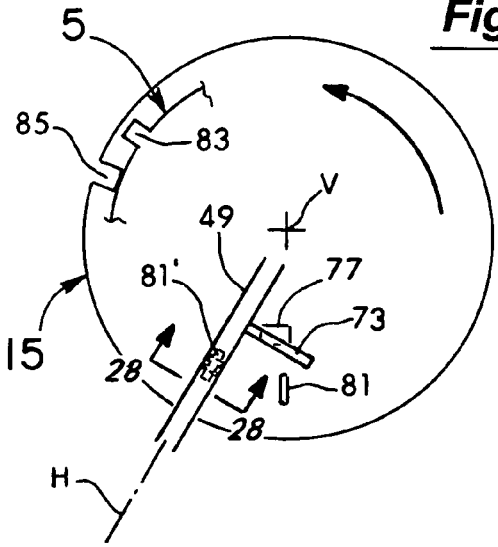
Figure 28:
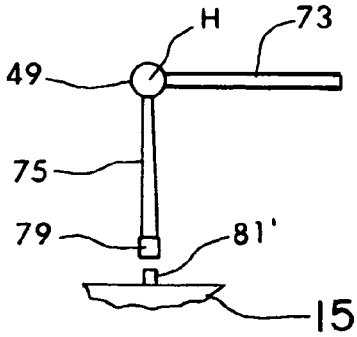

During the parking step in which the extended or raised antenna head 3 is initially rotated about the vertical axis V to its position aligned front-to-back with the vehicle 4 and then lowered, other sensors can be employed. For example and in the illustrated embodiment of FIGS. 10 and 23-28, once the down button 27 of FIG. 5 is pushed, the reed or other switch 81 in FIG. 27 is deactivated. This will happen regardless of where the support arrangement 5 and attached antenna head 3 actually are about the axis V. With the reed switch 81 deactivated, the support arrangement 5 and attached antenna head 3 including the shaft 49 will be rotated clockwise slightly beyond (e.g., one or two degrees) the position of FIGS. 25 and 26 until the stops 83 and 85 on the support arrangement 5 and base assembly 15 physically abut one another (see FIG. 23). The sequence of FIGS. 13-17 and 18-22 will then be reversed to rotate the shaft 49 and attached arm 73 clockwise in FIG. 24 about the axis H to engage and activate the trip switch 77. The down light 32 on the control panel 23 will thereafter light up to inform the operator that the antenna head 3 is properly and fully lowered for safe travel. The power button 25 can subsequently be turned off. It is noted that all of the operations of the support arrangement 5 and attached antenna head 3 described above have been simplified to be run by a single, reversible motor 41 which only needs to reverse the direction of rotation of the main drive gear 45 in FIGS. 10, 11, and 12.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A motorized, retractable antenna system including:

an antenna head (3) pivotally mounted to a support arrangement (5) for movement relative to said support arrangement about a substantially horizontal axis (H) between a predetermined, retracted position relative to said horizontal axis and an extended position, said support arrangement (5) being rotatably mounted to a base assembly (15) for movement relative to said base assembly about a substantially vertical axis (V) between at least a predetermined, first position relative to said vertical axis and a second position, said base assembly including a motor (41) to selectively drive said antenna head (3) and said support arrangement (5) respectively about said horizontal axis (H) and said vertical axis (V), and a locking mechanism for selectively securing said support arrangement in said predetermined, first position with said antenna head in said predetermined, retracted position.

2. The antenna system of claim 1 wherein said antenna head (3) is elongated and extends along respective substantially horizontal axes (13,14) in said extended and retracted positions.

3. The antenna system of claim 1 wherein said antenna head (3) is mounted to said support arrangement (5) for movement therewith about said vertical axis (V) with said antenna head (3) in said extended position.

4. The antenna system of claim 1 wherein said locking mechanism includes members to prevent said antenna head (3) from being driven by said motor about said horizontal axis (H) to said predetermined, retracted position when said support arrangement (5) is away from said predetermined, first position about said vertical axis (V).

5. The antenna system of claim 1 wherein said locking mechanism includes members to prevent said support arrangement (5) from being driven by said motor away from said predetermined, first position about said vertical axis (V) with said antenna head (3) away from said predetermined, extended position about said horizontal axis (H).

6. The antenna system of claim 1 wherein said extended position of said antenna head (3) about said horizontal axis (H) is predetermined and wherein said locking mechanism includes members to prevent said support arrangement (5) from being driven by said motor away from said predetermined, first position about said vertical axis (V) with said antenna head (3) away from said predetermined, extended position.

7. The antenna system of claim 1 wherein said extended position of said antenna head is predetermined and said locking mechanism includes at least two members mounted to selectively engage and disengage one another to selectively prevent and allow said support arrangement (5) to be driven by said motor about said vertical axis (V).

8. The antenna system of claim 7 wherein said at least two members mechanically engage and disengage one another.

9. The antenna system of claim 1 wherein said extended position of said antenna head is predetermined and said locking mechanism includes at least two members mounted to selectively engage and disengage one another to selectively allow and prevent said antenna head to be driven by said motor about said horizontal axis (H).

10. The antenna system of claim 9 wherein said at least two members mechanically engage and disengage one another.

11. The antenna system of claim 1 wherein said motor (41) moves a drive gear (45) about said vertical axis (V) in a first rotational direction, said drive gear (45) engaging a driven gear (47) mounted for movement with said antenna head (3) about said horizontal axis (H), said drive gear (45) moving said antenna head about said horizontal axis (H) from said predetermined, retracted position to said extended position and thereafter moving said support arrangement (5) about said vertical axis (V) away from said predetermined, first position, said antenna head (3) being mounted to said support arrangement (5) for movement therewith about said vertical axis (V) with said antenna head (3) in said extended position.

12. The antenna system of claim 11 wherein said motor (41) is reversible to rotate said drive gear (45) in a second rotational direction about said vertical axis (V) opposite to said first rotation direction to move said extended antenna head (3) and said support arrangement (5) to the predetermined, first position of said support arrangement and thereafter move said antenna head about said horizontal axis (H) to said predetermined, retracted position.

13. The antenna system of claim 1 wherein said antenna head (3) is moved about the horizontal axis (H) between said retracted and extended positions and said support arrangement (5) is rotated about the vertical axis (V) between said first and second positions by a single, reversible motor (41).

14. The antenna system of claim 1 further including at least a first gear (47) driven by said motor (41) and mounted for pivotal movement with said antenna head (3) about said horizontal axis (H), said base assembly (15) including a member (65) with a notch portion (63) forming part of the locking mechanism, said locking mechanism further including al least a member (53) with a detent (58) driven by said first gear (47) and mounted for pivotal movement relative to said support arrangement (5) between a locking position with said detent (58) received in said notch portion (63) and a free position with said detent (58) spaced from said notch portion (63), said detent (58) in said locking position preventing said support arrangement (5) from being driven by said motor (41) about said vertical axis (V) away from said predetermined, first position and said detent (58) in said free position allowing said support arrangement (5) to be driven by said motor about said vertical axis (V) away from said predetermined, first position.

15. The antenna system of claim 14 wherein said first gear (47) has a pin (50) spaced from and extending along said horizontal axis (H), said member (53) with said detent (58) being mounted for pivotal movement relative to said support arrangement about a second, substantially horizontal axis (57) spaced from said first mentioned horizontal axis (H), said member (53) having an indent (51) to receive said pin (50) as said first gear is driven in a first direction about said first mentioned horizontal axis (H), said pin binding against and pivoting said member (53) about said second horizontal axis (57) to move the detent (58) of said member (53) to said free position spaced from the notch portion (63) of the member (65) of the base assembly (15).

16. The antenna system of claim 15 further including a cam member (67) mounted to said first gear (47) and movable therewith about said first mentioned horizontal axis (H), said cam member (67) slidably engaging said member (53) to move the detent (58) thereof to said locking position received in said notch portion (63) and maintain said detent (58) in said locking position with said antenna head (3) in said predetermined, retracted position.

17. The antenna system of claim 1 wherein said antenna head (3) is elongated and extends along a substantially horizontal axis (14) in said predetermined, retracted position, said support arrangement (5) and base assembly (15) being located substantially along said horizontal axis (14) spaced from said antenna head (3).

18. The antenna system of claim 1 wherein said antenna head (3) is elongated and extends along a substantially horizontal axis (14) in said predetermined, retracted position.

19. The antenna system of claim 1 wherein said base assembly (15) is mounted to a vehicle.

20. The antenna system of claim 19 wherein said antenna head (3) is elongated and extends along a substantially horizontal axis (14) in said predetermined, retracted position oriented substantially front-to-back relative to said vehicle.

21. The antenna system of claim 20 wherein said support arrangement (5) and base assembly (15) are located substantially along said horizontal axis (14) in front of said antenna head (3) relative to said vehicle.

* * * * *